US006540325B2

(12) United States Patent
Kawamura et al.

(10) Patent No.: US 6,540,325 B2
(45) Date of Patent: Apr. 1, 2003

(54) PRINTER PRINTHEAD

(75) Inventors: Naoto A. Kawamura, Corvallis, OR (US); Timothy L. Weber, Corvallis, OR (US)

(73) Assignee: Hewlett-Packard Company, Palo-Alto, CA (US)

( * ) Notice: Subject to any disclaimer, the term of this patent is extended or adjusted under 35 U.S.C. 154(b) by 0 days.

(21) Appl. No.: 09/800,873

(22) Filed: Mar. 6, 2001

(65) Prior Publication Data

US 2001/0012032 A1 Aug. 9, 2001

Related U.S. Application Data

(63) Continuation of application No. 09/300,785, filed on Apr. 27, 1999, which is a continuation-in-part of application No. 08/738,516, filed on Oct. 28, 1996, now Pat. No. 6,113,221, which is a continuation-in-part of application No. 08/597,746, filed on Feb. 7, 1996, now Pat. No. 6,000,787, and a continuation-in-part of application No. 09/240,286, filed on Jan. 29, 1999, now Pat. No. 6,155,670, which is a continuation-in-part of application No. 08/812,385, filed on Mar. 5, 1997, now Pat. No. 6,099,108.

(51) Int. Cl.[7] ..... B41J 2/15
(52) U.S. Cl. ..... 347/40; 347/12; 347/58
(58) Field of Search ..... 347/40, 43, 12, 347/15, 62, 63, 44, 68, 58

(56) References Cited

U.S. PATENT DOCUMENTS

| | | | | |
|---|---|---|---|---|
| 4,339,762 | A | 7/1982 | Shirato et al. | 347/62 |
| 4,396,924 | A | 8/1983 | Rosenstock | 347/68 |
| 4,415,909 | A | 11/1983 | Italiano et al. | 347/68 |
| 4,514,741 | A | 4/1985 | Meyer | 347/62 |
| 4,550,326 | A | 10/1985 | Allen et al. | 347/44 |
| 4,578,687 | A | 3/1986 | Cloutier et al. | 347/44 |
| 4,621,273 | A | 11/1986 | Anderson | 347/40 |
| 4,694,308 | A | 9/1987 | Chan et al. | 347/65 |
| 4,847,630 | A | 7/1989 | Bhaskar et al. | 347/63 |
| 4,870,433 | A | 9/1989 | Campbell et al. | 347/62 |
| 4,894,664 | A | 1/1990 | Tsung Pan | 347/63 |
| 4,967,203 | A | 10/1990 | Doan et al. | 347/41 |
| 4,972,270 | A | 11/1990 | Kurtin et al. | 358/296 |
| 4,999,646 | A | 3/1991 | Trask | 347/41 |
| 5,006,864 | A | 4/1991 | Ayata et al. | 347/58 |
| 5,103,246 | A | 4/1992 | Dunn | 347/58 |
| 5,245,244 | A | 9/1993 | Takahashi et al. | 310/328 |
| 5,258,774 | A | 11/1993 | Rogers | 347/40 |
| 5,357,081 | A | 10/1994 | Bohorquez | 219/497 |
| 5,508,724 | A | 4/1996 | Boyd et al. | 347/58 |
| 5,541,629 | A | 7/1996 | Saunders et al. | 347/12 |
| 5,563,635 | A | 10/1996 | Kneezel et al. | 347/12 |
| 5,598,189 | A | 1/1997 | Hess et al. | 347/9 |
| 6,000,787 | A | 12/1999 | Weber et al. | 347/65 |
| 6,099,108 | A | 8/2000 | Weber et al. | 347/43 |

FOREIGN PATENT DOCUMENTS

| | | | |
|---|---|---|---|
| EP | 0124312 A2 | 11/1984 | B41J/3/04 |
| EP | 0517519 A2 | 12/1992 | B41J/2/205 |
| EP | 0627314 A2 | 12/1994 | B41J/2/14 |
| EP | 0688671 A2 | 12/1995 | B41J/2/015 |
| EP | 0698492 A2 | 2/1996 | B41J/2/05 |
| EP | 0730961 A1 | 9/1996 | B41J/2/05 |
| EP | 0855277 A2 | 7/1998 | B41J/2/205 |
| EP | 0938976 A1 | 9/1999 | B41J/2/505 |

*Primary Examiner*—Lamson Nguyen
(74) *Attorney, Agent, or Firm*—Raymond A. Jenski

(57) ABSTRACT

An inkjet printing device is arranged to employ a first set of multiple nozzle drop generators activated by a first address signal and a second set of multiple nozzle drop generators activated by a second address signal. The multiple nozzles of each drop generator of the first set are arranged in a predetermined geometric pattern, each of which encompasses at least one nozzle of a drop generator of the second set. The ink ejectors of one drop generator of the first drop generator set are arranged in subgroups, one subgroup of which shares a switched power return with one subgroup of ink ejectors of one drop generator of the second drop generator set.

11 Claims, 12 Drawing Sheets

PRINTER PRINTHEAD

CROSS REFERENCE TO RELATED APPLICATION(S)

This is a continuation of application Ser. No. 09/300,785 filed on Apr. 27, 1999 which is a continuation-in-part of U.S. patent application Ser. No. 08/738,516 filed Oct. 28, 1996 now U.S. Pat. No. 6,113,221 (which is a continuation-in-part of U.S. patent application Ser. No. 08/597,746 filed Feb. 7, 1996 now U.S. Pat. No. 6,000,787) and Ser. No. 09/240,286 filed Jan. 29, 1999 now U.S. Pat. No. 6,155,670, (which is a continuation-in-part of U.S. patent application Ser. No. 08/812,385 filed Mar. 5, 1997 now U.S. Pat. No. 6,099,108), each of which is assigned to the assignee of the present invention.

BACKGROUND OF THE INVENTION

The present invention relates generally to methods and apparatus for reproducing images and alphanumeric characters, and more particularly to a thermal inkjet, multi-nozzle drop generator, printhead construction, and its method of operation.

The art of inkjet printing technology is relatively well developed. Commercial products such as computer printers, graphics plotters, copiers, and facsimile machines employ inkjet technology for producing hard copy printed output. The basics of this technology are disclosed, for example, in various articles in the *Hewlett-Packard Journal*, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994) editions. Inkjet devices are also described by W. J. Lloyd and H. T. Taub in *Output Hardcopy Devices*, chapter 13 (Ed. R. C. Durbeck and S. Sherr, Academic Press, San Diego, 1988).

The quality of a printed image has many aspects. When the printed matter is an image, it is the goal of a printing system is to accurately reproduce the appearance of the original. To achieve this goal, the system must accurately reproduce both the perceived colors (hues) and the perceived relative luminance ratios (tones) of the original. Human visual perception quickly adjusts to wide variations in luminance levels, from dark shadows to bright highlights. Between these extremes, perception tends toward an expectation of smooth transitions in luminance. Printing devices and similar imaging systems generally create an output that reflects light to provide a visually observable image. Exceptions such as transparencies exist, of course, but for consistency, the term reflectance will be used to denote the optical brightness of the printed output from a printing device. Generally speaking, reflectance is a ratio of the light reflected from a surface to that incident upon it. The colorants deposited upon the medium by inkjet printers are usually considered to be absorbers of particular wavelengths of light energy. This selective absorption prevents selected wavelengths of the light energy incident upon the medium from reflecting from the medium and is perceived by humans as color. Printing systems have yet to achieve complete and faithful reproduction of the full dynamic range and perception continuity of the human visual system. While it is a goal to achieve the quality of photographic image reproduction, printing dynamic range capabilities are limited by the sensitivity and saturation level limitations inherent to the recording mechanism, although the effective dynamic range can be extended somewhat by utilizing non-linear conversions that allow some shadow and highlight detail to remain.

An inkjet printer for inkjet printing typically includes a print cartridge in which small drops of ink are formed and ejected towards a print medium. Such cartridges include a printhead having an orifice member or plate that has a plurality of small nozzles through which ink drops are ejected. Adjacent to the nozzles are ink-firing chambers, where ink resides prior to ejection through the nozzle. Ink is delivered to the ink-firing chambers through ink channels that are in fluid communication with an ink supply, which may be contained in a reservoir portion of the pen or in a separate ink container spaced apart from the printhead.

Ejection of an ink drop through a nozzle may be accomplished by quickly heating a volume of ink within the adjacent ink firing chamber by selectively energizing a heater resistor positioned in the ink firing chamber. This thermal process causes ink within the chamber to vaporize and form a vapor bubble. The rapid expansion of the bubble forces ink through the nozzle.

Once ink is ejected, the ink-firing chamber is refilled with ink from the ink channel. This ink channel is typically sized to refill the ink chamber quickly to maximize print speed. Ink channel damping is sometimes provided to dampen or control inertia of the moving ink flowing into and out of the firing chamber. By damping the ink flow between the ink channel and the firing chamber, the oscillatory underfilling and overfilling of the firing chamber and the resulting meniscus recoiling and bulging from the external orifice of the nozzle, respectively, can be avoided or minimized.

As the vapor bubble expands within the firing chamber the expanding vapor bubble can extend into the ink channel in a detrimental action known as "blowback". Blowback tends to result in forcing ink in the ink channel away from the firing chamber. The volume of ink which the bubble displaces is accounted for by both the ink ejected through the nozzle and ink which is forced down the ink channel away from the firing chamber. Therefore, blowback increases the amount of energy necessary for ejecting droplets of a given size from the firing chamber. The energy required to eject a drop of a given size is referred to as "turn on energy". Printheads having high turn-on energies tend to be less efficient and therefore, have more heat to dissipate than lower turn-on energy printheads. Assuming a fixed capacity to dissipate heat, printheads that have a higher thermal efficiency are capable of a higher printing speed or printing frequency than printheads that have a lower thermal efficiency.

Following removal of electrical power from the heater resistor, the vapor bubble collapses in the firing chamber. Components within the printhead in the vicinity of the vapor bubble collapse are susceptible to cavitation stresses as the vapor bubble collapses between firing intervals. The heater resistor is particularly susceptible to damage from cavitation. A hard thin protective passivation layer is typically applied over the resistor to protect the resistor from stresses resulting from cavitation. The passivation layer, however, tends to increase the turn-on energy required for ejecting droplets of a given size.

In inkjet technology, which uses dot matrix manipulation to form both images and alphanumeric characters, the colors and tone of a printed image are modulated by the presence or absence of drops of ink deposited on the print medium at each target picture element (known as a "pixel") generally represented as a superimposed rectangular grid overlay of the image. The medium reflectance continuity—tonal transitions within the recorded image on the medium—is especially affected by the inherent quantization effects of using quanta of ink drops and dot matrix imaging. These quantization effects can appear as a contouring in a printed image where the original image had smooth transitions. Moreover the printing system can introduce random or systematic reflectance fluctuations or graininess which is the visual recognition of individual or clusters of dots with the naked eye.

Perceived quantization effects which detract from print quality can be reduced by decreasing the density quanta at each pixel location in the imaging system and by utilizing techniques that exploit the psycho-physical characteristics of the human visual system to minimize the human perception of the quantization effects. It has been estimated that the unaided human visual system will perceive individual ink dots until they have been reduced to approximately twenty-five microns in diameter or less on in the printed image. Therefore, undesirable quantization effects of the dot matrix printing method have been reduced by decreasing the size of each drop and printing at a high resolution; that is, a true 1200 dots per inch ("dpi") placement of small dots on a printed image looks better to the eye than a true 600 dpi image of larger dots, which in turn improves upon 300 dpi of even larger dots, etc. Additionally, undesired quantization effect can be reduced by utilizing more colors with varying densities of color (e.g., two cyan ink print cartridges, each containing a different ratio of dye to solvent in the chemical composition of the ink) or containing different types of chemical colorants.

To reduce quantization noise effects, print quality also can be enhanced by firing multiple drops of the same color or color formulation at each pixel resulting in more "levels" per color and reducing quantization noise. Such methods are discussed in U.S. Pat. No. 4,967,203 to Alpha N. Doan et al. for an "Interlace Printing Process", U.S. Pat. No. 4,999,646 to Jeffrey L. Trask for a "Method for Enhancing the Uniformity and Consistency of Dot Formation Produced by Color Ink Jet Printing", and U.S. Pat. No. 5,583,550 to Mark S. Hickman et al. for "Ink Drop Placement for Improved Imaging" (each assigned to the assignee of the present invention).

One can also reduce graininess in a picture by essentially low pass filtering the printed image with smoothing techniques that decrease resolution but, importantly, reduce noise. One such technique dilutes the ink (by one-fourth the original optical density by adding three parts solvent) such that the ink drop which would have been deposited on a single pixel (in, for example, a 600 dpi resolution) is spread over at least portions of adjacent pixel areas. While each drop would contain the same amount of colorant, the additional solvent causes the colorant to be distributed over a wider area. As stated, this lowers the visual noise at the cost of perceived resolution. Additionally, this technique places substantially more solvent on the printed medium resulting in an unacceptably long time to dry, consumes much more ink for printing, and slows down the speed of printing In multiple drop modes of printing, the resulting dots vary in size or in color depending on the number of drops deposited in an individual pixel and the constitution of the ink with respect to its spreading characteristics after impact on the particular medium being printed (plain paper, glossy paper, transparency, etc.). The reflectance and color of the printed image on the medium is modulated by manipulating the size and densities of drops of each color at each target pixel. The quantization effects of this mode can be reduced in the same ways as for the singledrop per pixel mode. The quantization levels can also be reduced at the same printing resolution by increasing the number of drops that can be fired at one time from nozzles in a printhead array and either adjusting the density of the ink or the size of each drop fired so as to achieve full dot density. However, simultaneously decreasing drop size and increasing the printing resolution, or increasing the number of cartridges and varieties of inks employed is expensive, so older implementations of inkjet printers designed specifically for imaging art reproduction generally use multi-drop modes or multiple passes to improve color saturation.

When the size of the printed dots is modulated, the image quality is very dependent on dot placement accuracy and resolution. Misplaced dots leave unmarked pixels which appear as white dots or even bands of white lines within or between print swaths (known as "banding"). Mechanical tolerances become increasingly critical in the construction as the printhead geometries of the nozzles are reduced in order to achieve a resolution of true 600 dpi or greater. Therefore, the cost of manufacture increases with the increase of the resolution design specification. Furthermore, as the number of drops fired at one time by multiplexing nozzles increases, the minimum nozzle drop volume decreases, dot placement precision requirements increase. Also the thermal efficiency of the printhead becomes low, leading to high printhead temperatures. High printhead temperatures can lead to reliability problems, including ink outgassing, gassing, erratic drop velocities due to inconsistent bubble nucleation, and variable drop weight due to ink viscosity changes. Moreover, when the density of the printed dots is modulated as in multi-dye load ink systems, the low dye load inks require that more ink be placed on the print media, resulting in less efficient ink usage and higher risk of ink coalescence and smearing. Ink usage efficiency decreases and risk of coalescence and smearing increases with the number of drops fired at one time from the nozzles of the printhead array.

Smaller drops naturally suggest smaller nozzles. As the nozzle area is made smaller, the nozzle becomes more susceptible to plugging by solid contaminants in the ink or by particles created in the process of manufacturing the print cartridge. Additionally, the smaller nozzles require a thinner orifice plate as the size of the entire drop generator mechanism is made smaller.

In light of the foregoing, it is desirable to obtain an inkjet printhead and printing system in which small drops are reliably expelled and deposited upon a print medium in such a manner that a high degree of visual dynamic range concurrent with reduced quantization and granularity.

SUMMARY OF THE INVENTION

As inkjet printing device encompasses a first drop generator, activated by a first signal, includes at least two associated nozzles and respective ink ejectors. Each nozzle of the at least two associated nozzles of the first drop generator is arranged in a first geometric pattern with each other nozzle of the first drop generator. A second drop generator, activated by a second signal, includes at least two associated nozzles and respective ink ejectors. Each nozzle of the at least two associated nozzles of the second drop generator is arranged in a second geometric pattern with each other nozzle of the second drop generator. At least one nozzle associated with the second drop generator is disposed on or within the perimeter of the first geometric pattern of nozzles of the first drop generator.

DESCRIPTION OF THE PREFERRED EMBODIMENTS

A printer having improved visual dynamic range and reduced granularity and quantization of ink dots needs to deposit ink dots on a medium in a controllable pattern and with a selectable number of dots in the pattern. A printer employing the present invention gains these advantages without sacrificing speed of printing.

Figure 1:
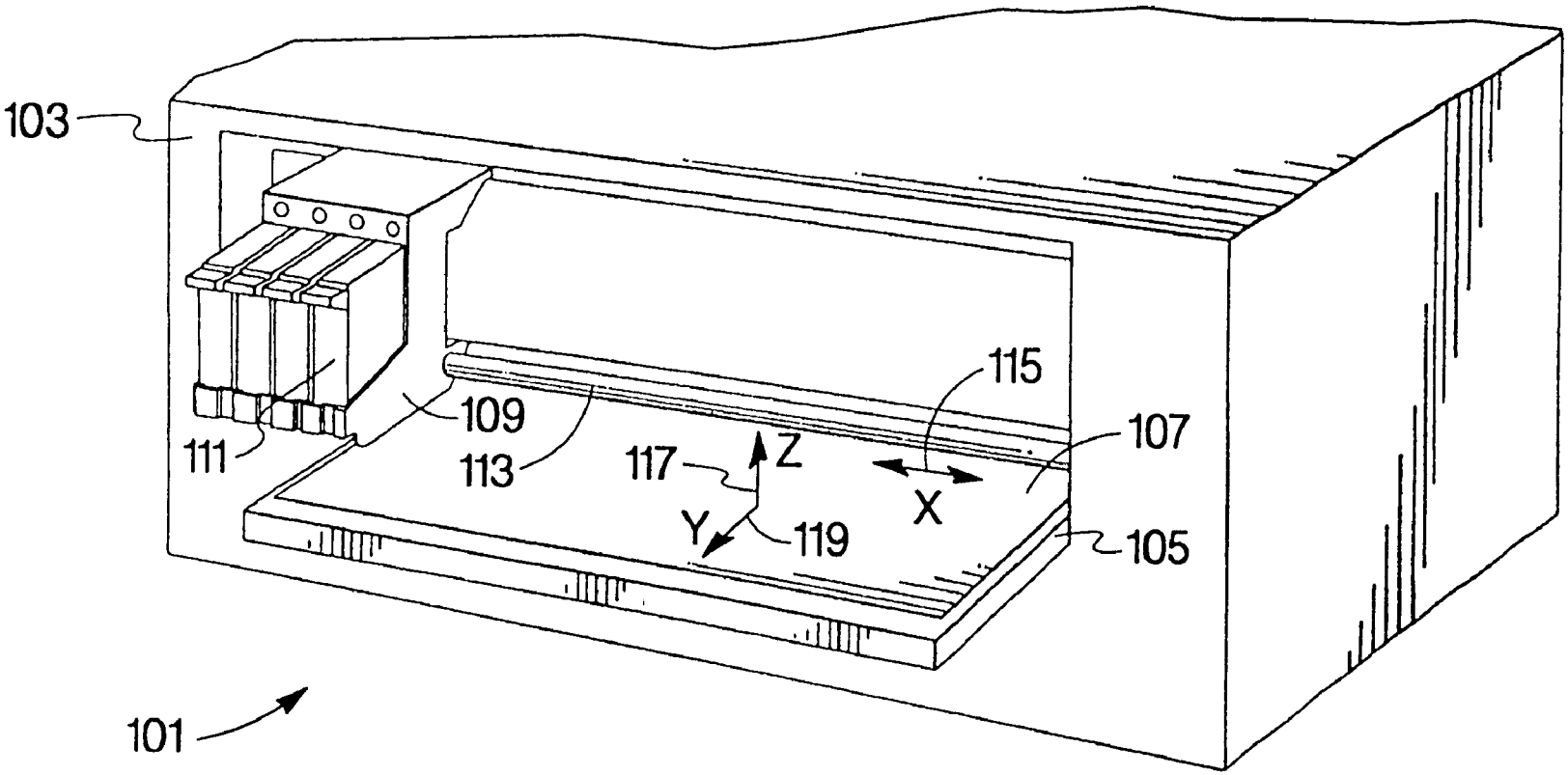
FIG. 1 is an illustration in perspective view (partial cut-away) of an inkjet apparatus (cover panel facia removed) in which the present invention may be incorporated.

An exemplary inkjet printer 101 is shown in rudimentary form in FIG. 1. A printer housing 103 contains a platen 105 to which input print media 107 is transported by mechanisms which are known in the art. A carriage 109 holds a set of individual print cartridges, e.g. 111, one having cyan ink, one having magenta ink, one having yellow ink, and one having black ink. Alternative embodiments can include semi-permanent printhead mechanisms having at least one small volume, on-board, ink chamber that is sporadically replenished from fluidically-coupled, off-axis, ink reservoirs or print cartridges having two or more colors of ink available within the print cartridge and ink ejecting nozzles specifically designated for each color; the present invention is applicable to inkjet cartridges of any of the alternatives.) The carriage 109 is typically mounted on a slide bar 113, allowing the carriage 109 to be scanned, i.e., repositioned with respect to the medium pack and forth across the print media 107. The scan axis, "X," is indicated by arrow 115. As the carriage 109 scans, ink drops are selectively ejected from the set of print cartridges onto the media 107 in predetermined print swath patterns, forming images or alphanumeric characters using dot matrix manipulation. Generally, the dot matrix manipulation is determined by an external computer (not shown) and instructions are conventionally transmitted to a microprocessor-based electronic controller (not shown) within the printer 101. The ink drop trajectory axis, "Z," is indicated by arrow 117. When a swath of print has been completed, the media 107 is moved an appropriate distance along the print media axis, "Y," indicated by arrow 119 in preparation for the printing of the next swath.

Figure 2:
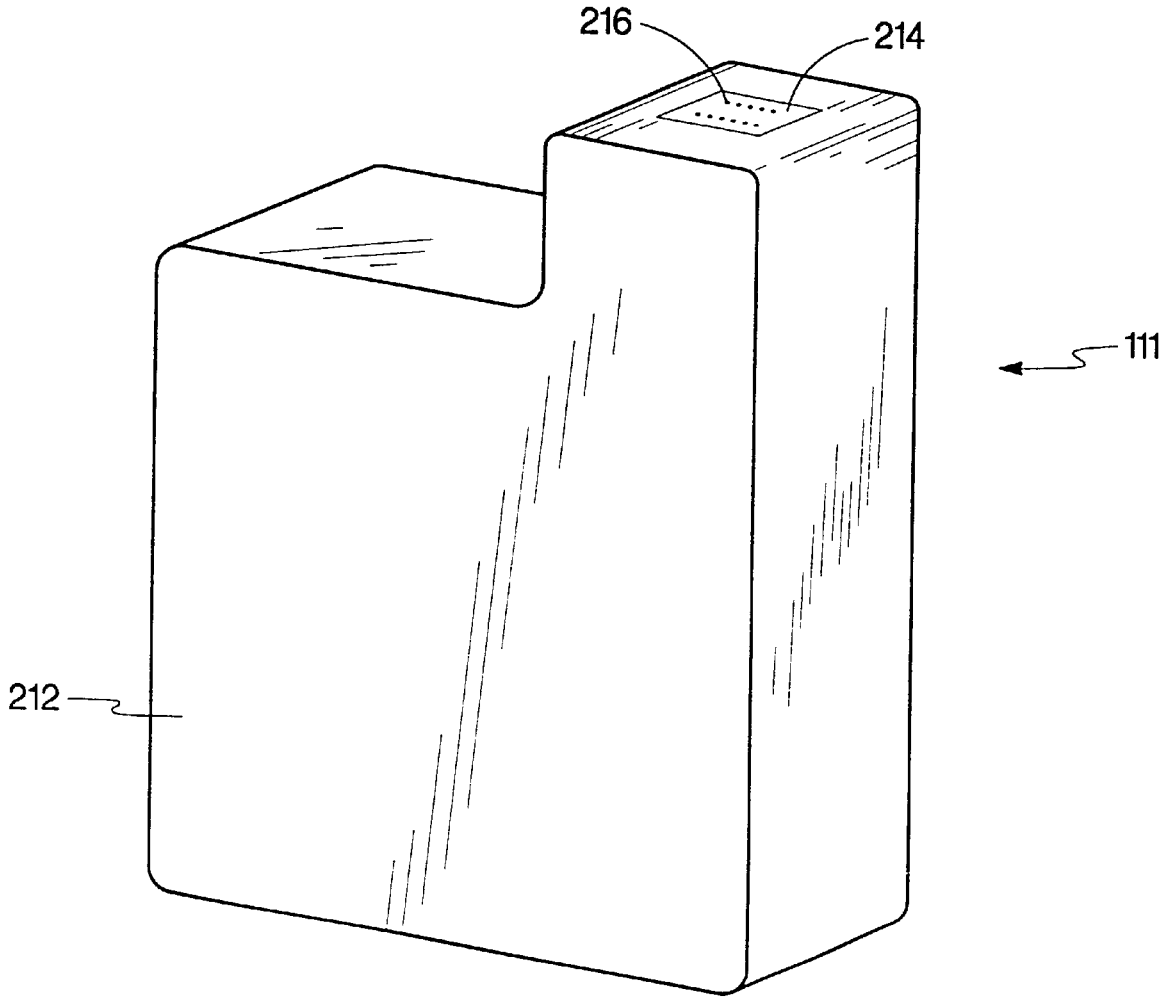
FIG. 2 is an isometric illustration of an inkjet print cartridge component of FIG. 1.

An exemplary thermal inkjet cartridge 111 is shown in FIG. 2. A cartridge housing, or shell, 212 contains an internal reservoir of ink (not shown). The cartridge 210 is provided with a printhead 214, that includes an orifice plate 216, having a plurality of miniature nozzles constructed in combination with subjacent firing chambers and structures leading to respective ink ejectors, and electrical contacts for coupling to the printer 101. Related sets of nozzles, associated related sets of firing chambers, and associated related sets of ink ejectors taken together form a printhead array of "drop generators", each of which employs one or more nozzles, firing chambers, and heater resistors as ink ejectors. This is shown in the cross sectional detail of FIG. 3, taken though a drop generator.

Figure 3:
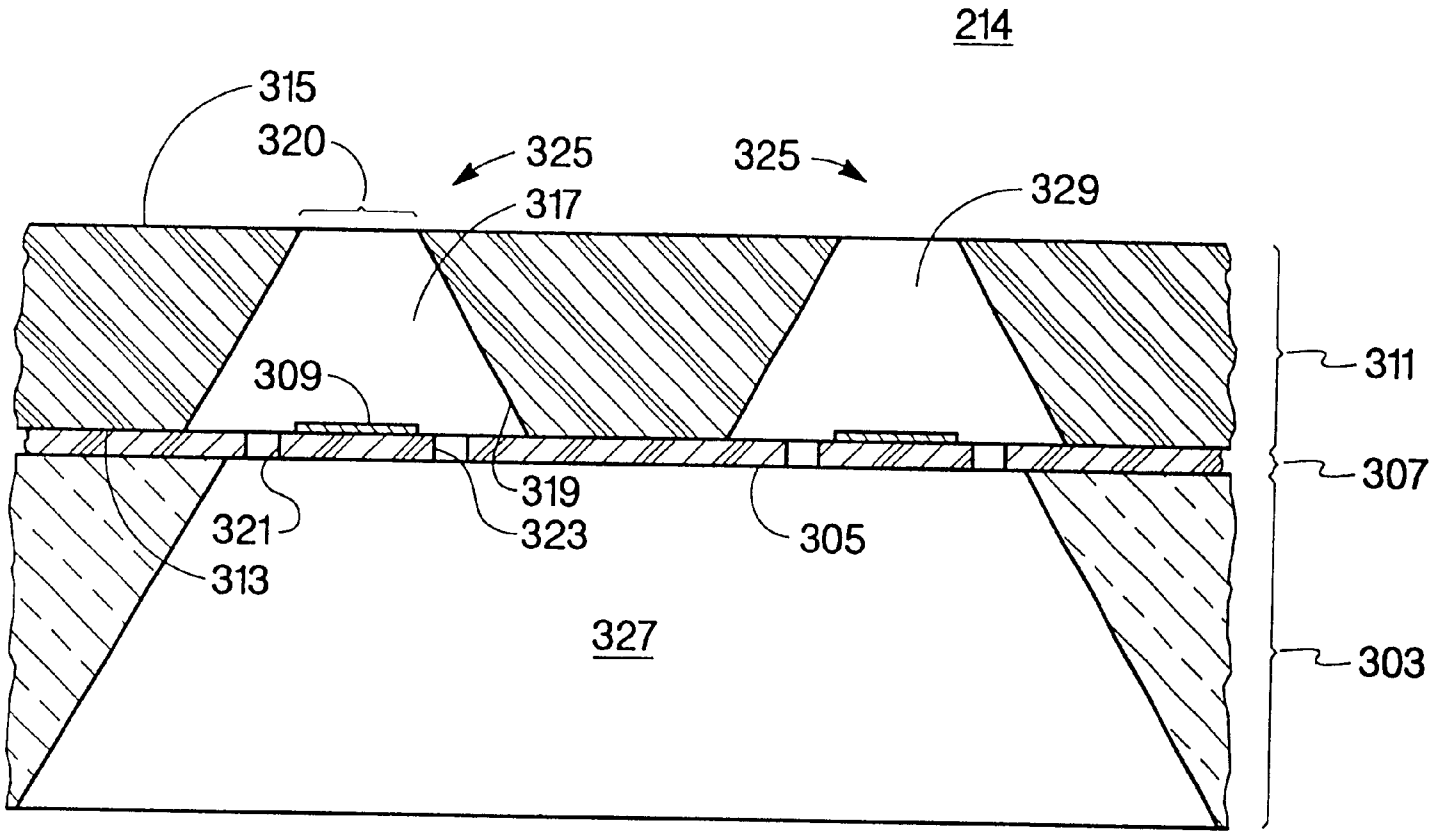
FIG. 3 is a magnified cross section of a drop generator element of the printhead component of FIG. 2.

A drop generator and associated ink feed channel of printhead 214 is shown in the cross section of FIG. 3. It includes a semi-conductor substrate 303 that provides a rigid base for the printhead, and which accounts for the majority of the thickness of the printhead. The substrate has an upper surface 305 that is coated with a support layer 307 upon which rests a thin film heater resistor ink ejector 309. The support layer 307 is formed of an electrically insulating material such as silicon dioxide, silicon nitride, silicon carbide, tantalum, polysilicon glass or other functionally equivalent material having different etchant sensitivity than the substrate 303 of the printhead. The orifice plate 311 has a lower surface 313 that conformally rests atop the support layer, and has an exterior surface 315 that forms the uppermost surface of the printhead and faces the print medium upon which ink is to be deposited.

The center point of the heater resistor 309 defines a normal axis normal on which the components of the firing chamber are aligned. In FIG. 3, the orifice plate 311 defines at least two firing chambers, each with its own ink ejector (heater resistor) and nozzle. When the ink ejectors are coordinated to simultaneously eject a drop upon command, they form a drop generator. Considering now one firing chamber 317 of the illustrated drop generator 325, the ink-firing chamber 317 is aligned on one ink ejector 309 axis. The firing chamber 317 has a larger base periphery 319 at the lower surface 313 than the smaller nozzle orifice 320 at the exterior surface, although other nozzle cross sectional designs will perform satisfactorily in the present invention. The support layer 307 includes several ink supply vias 321, 323 dedicated to the firing chamber 317. The vias 321, 323 are encompassed by the firing chamber's lower periphery 319, so that the ink they supply is exclusively used by that firing chamber, and so that any pressure generated within the firing chamber will not generate ink flow to other chambers, except for the limited amount that may flow back through the vias, below the upper surface of the substrate. This prevents blowback from significantly affecting adjacent firing chambers, and prevents pressure leakage that might otherwise significantly reduce the expulsive force generated by the energy provided by the heater resistor 309. The use of more than a single via per firing chamber provides redundant ink flow paths to prevent ink starvation by a single contaminant particle in the ink. In a preferred embodiment, the upper surface of the support layer 307 is patterned and etched to form the vias 321, 323 before the orifice plate 311 is attached and before a tapered trench 327 is etched into the substrate 303 as described below. A second firing chamber 329 is also shown in FIG. 3 and will have its associated ink ejector electrically connected, as described below, to the ink ejector 309 so that a coordinated ejection of two ink droplets will occur when the drop generator 325 is activated.

The substrate 303, in a preferred embodiment, utilizes a tapered ink feed trench 327, shown in end view, that is widest at the lower surface of the substrate to receive ink from an ink reservoir, and which narrows toward the support layer 307 to a width greater than the domain of the ink vias of both firing chambers of drop generator 325. The cross sectional area of the trench 327 is many times greater than the cross sectional area of the ink vias associated with a single drop generator, so that a multitude of drop generators may be supplied without significant ink flow resistance in the trench.

The orifice plate 311 is preferably laid over and affixed to the substrate 303 and on the upper surface of the support layer 307. In the printhead embodiment of FIG. 3, the orifice plate 311 is preferably formed using a spin-on or laminated polymer. The polymer is applied to a thickness of about 10 to 30 $\mu$m. Any suitable photo imagable polymer film may be used, for example polyamide, polymethylmethacrylate, polycarbonate, polyester, polyamide, polyethyleneterephthalate or mixtures thereof. Alternatively, the orifice may be formed of a gold-plated nickel member manufactured by conventional electrodeposition techniques. Preferably, the trench 327 is etched by an anisotropic etching process from the lower side of the substrate 303 to the upper surface 305 of the support layer 307.

Fluid ink stored in a reservoir of the cartridge housing 212 flows by capillary force through each trench 327 created in the printhead substrate 303 and through the vias to fill the firing chambers. It is expected that, the trench be oriented to provide ink to a set of drop generators and a plurality of trenches will feed additional sets of drop generators. In the preferred embodiment, each trench extends to connect with the ink storage reservoir. The substrate 303 is bonded to the cartridge housing surface, which surface defines a lower boundary of the trench 327.

Nozzle configurations and orientations are design factors that control droplet size, velocity and trajectory of the droplets of ink in the Z-axis (toward the medium to be printed upon). The conventional drop generator configuration has one orifice and is fired in either a single-drop per pixel or multi-drop per pixel print mode. In the single-drop mode, one ink drop is selectively fired from each nozzle from each print cartridge toward a respective target pixel on the print media 107 (that is, a target pixel might get one drop of yellow from a nozzle and two drops of cyan from another nozzle in successive scans of the carriage to achieve a specific color hue); in a multi-drop mode, to improve saturation and resolution, two sequential droplets of yellow and four of cyan might be used for a particular hue that might be done on one pass of the carriage. (For the purpose of this description, a target pixel means a pixel which a drop generator is traversing as an inkjet printhead is scanned across an adjacent print medium, taking into consideration the physics of firing, flight time, trajectory, nozzle configuration, and the like which would be known to a person skilled in the art; that is, in a conventional printhead it is the pixel at which a particular drop generator is aiming. However, the current invention may form dots in pixels other than the currently traversed pixel, i.e., other than the traditional target pixel.) The resulting dot on the print media is approximately the same size and color as the dots from the same and other nozzles on the same print cartridge. It is a feature of the present invention that a drop generator comprises a plurality of nozzles for ejecting ink.

Figure 4A:
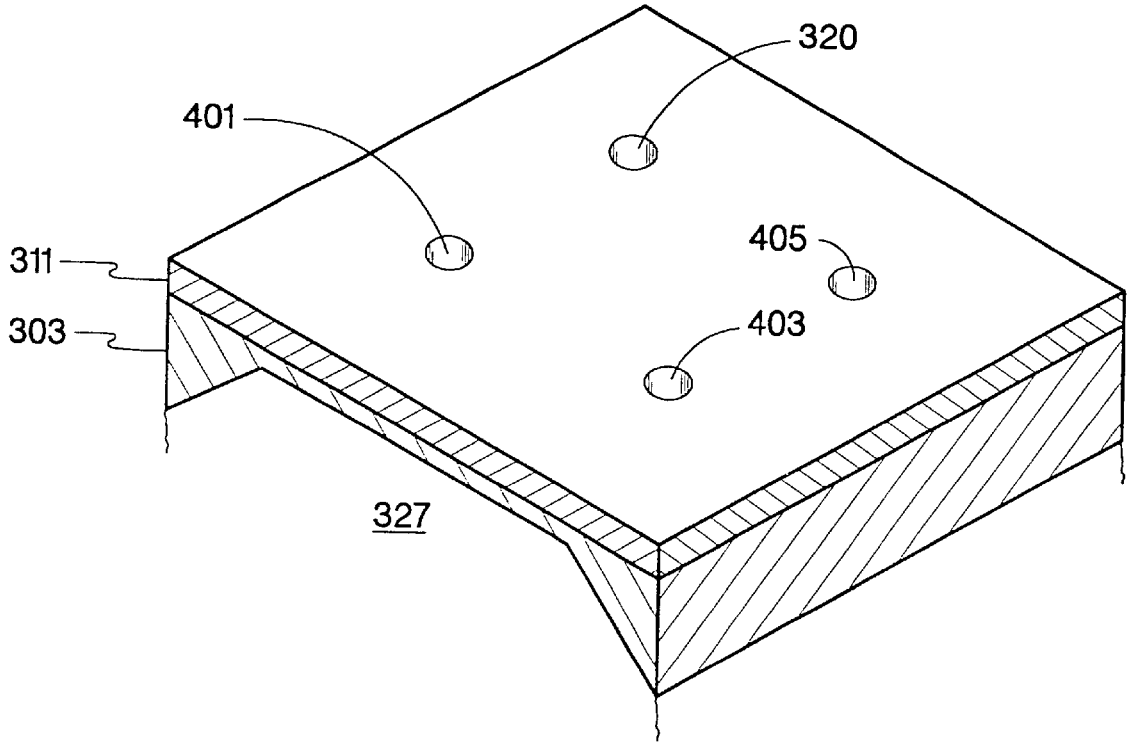
FIG. 4A is an isometric cross section of the printhead of the print cartridge of FIG. 2, illustrating the external surface nozzle orifices of a drop generator.

A segment of a printhead is illustrated in the isometric cross section of FIG. 4A. Visible at the exterior surface of the orifice plate 311 are four nozzle orifices 320, 401, 403, and 405 which represent the external appearance of an individual drop generator which may be employed in the preferred embodiment. The orifices each have an associated ink ejector in the form of one or more heater resistors that are disposed on the support layer 307 (as previously described but not shown in FIG. 4A). The nozzles and the ink ejectors are each respectively arranged in a predetermined geometric pattern. In the preferred embodiment of four nozzles per drop generator, the predetermined geometric pattern is a parallelogram.

Figure 4B:
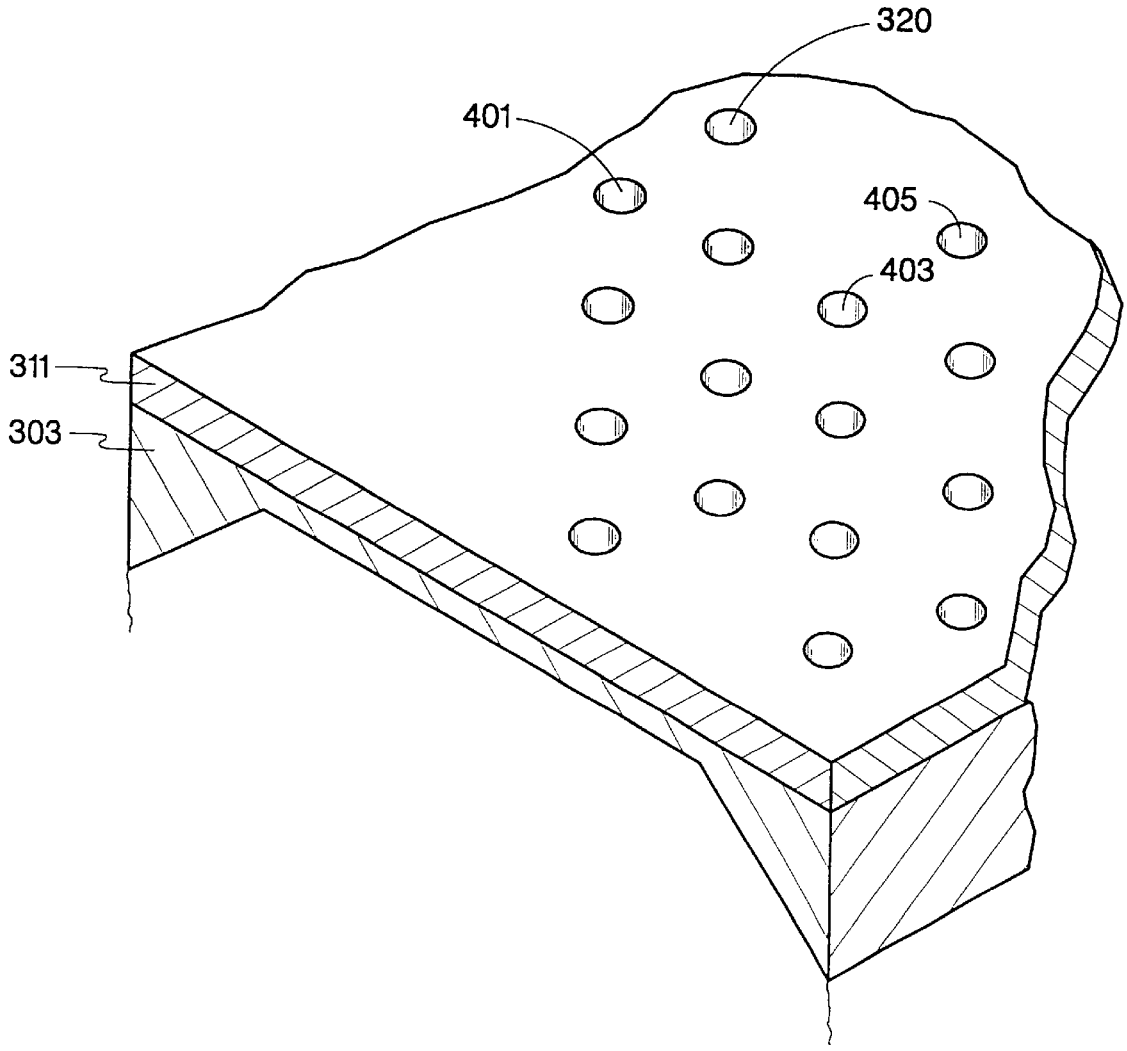
FIG. 4B is an isometric cross section of the printhead of the print cartridge of FIG. 2, illustrating the external surface nozzle orifices of a plurality of drop generators.

In practice, a large number of drop ejectors are grouped in a printhead to provide a print swath width of reasonable size such that a swath of text or image can be deposited upon the print medium in one pass of the print cartridge across the print medium. Of course, should the printhead be constructed to be of sufficient size, a complete page width of ink may be deposited on the medium without reciprocal scan of the printhead. While the printhead of the present invention may be expanded in size to a full page-wide dimension, the preferred embodiment utilizes a smaller (1.25 cm) printhead which is reciprocated across the medium. A preferred arrangement of the plurality of drop ejectors, each with four nozzle orifices at the external surface of the orifice plate 311 is shown in FIG. 4B. An overlap of nozzle orifices from neighboring drop generators is readily apparent in this embodiment and such an arrangement provides a desirable ink dot distribution on the medium. Advantageously, ink dots are placed with an overlap between pixels so that banding artifacts, Moire' patterns, and other printing errors are camouflaged or avoided. This placement is particularly advantageous when used in a single-pass mode of printing.

Figure 4C:
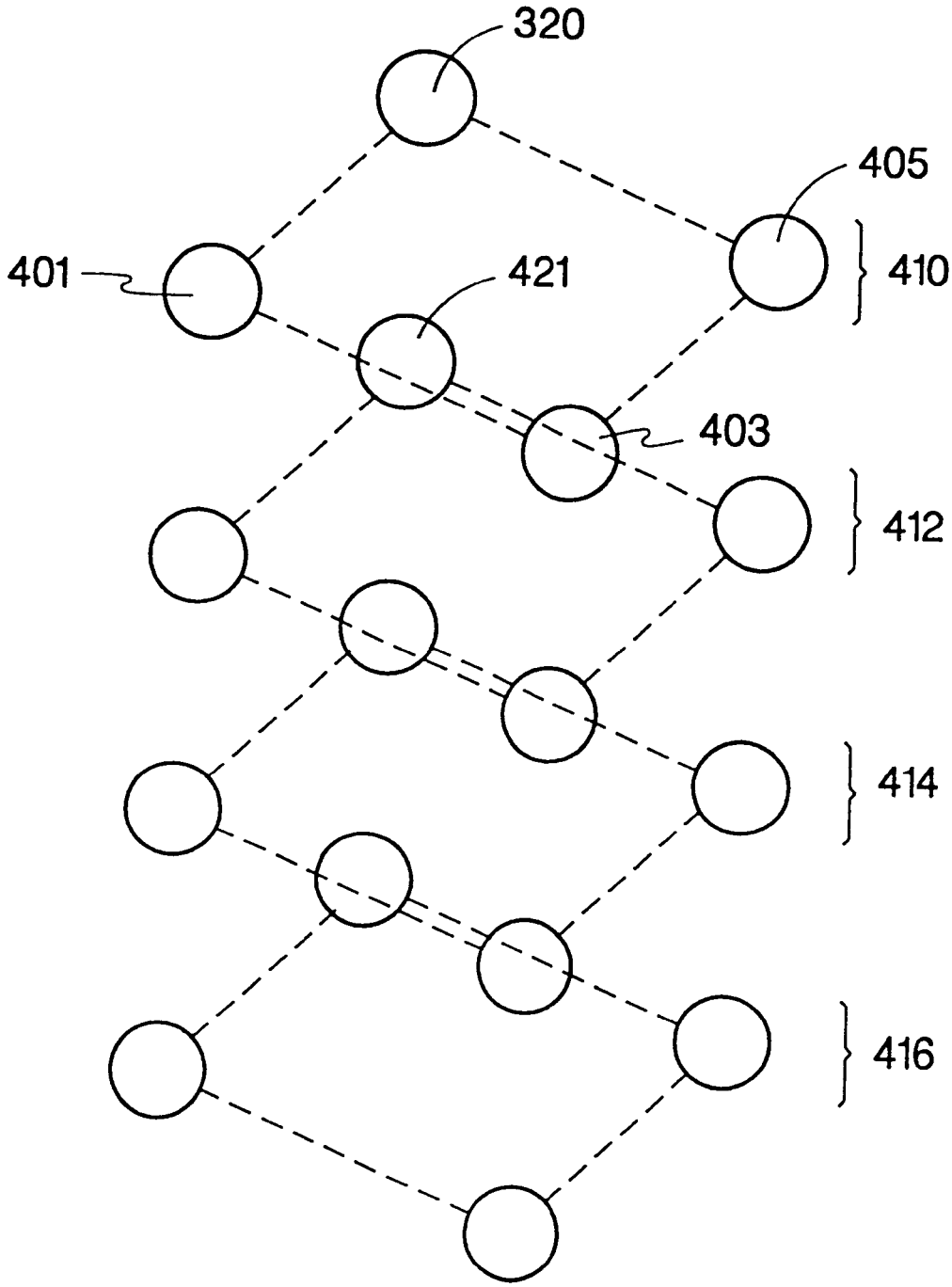
FIG. 4C is an illustration of the pattern of nozzle orifices of FIG. 4B.

It is a feature of the present invention that the nozzle orifices of neighboring drop generators have the overlapping disposition on the orifice plate. The overlapping pattern, of course, is maintained for the corresponding firing chamber and ink ejector of each nozzle. In the preferred embodiment, the nozzles of one drop generator are arranged in a predetermined geometric pattern. Such a pattern is illustrated in the nozzle orifice pattern shown in FIG. 4C. Broken lines, for ease of understanding, join the four nozzle orifices of each drop generator (the printhead details of FIG. 4B are omitted for clarity) and each drop generator set is identified as drop generator arrangement 410, arrangement 412, arrangement 414, and arrangement 416. It is clear that at least one nozzle orifice, for example orifice 421, of a neighboring drop generator (arrangement 412) is placed on or within the perimeter of the nozzle orifices 320, 410, 403, 405 of the drop generator arrangement 410.

As previously mentioned, the ink ejectors (heater resistors) track the position of the nozzle orifices. Placing nozzle orifices close together presents a problem in the designing of ink ejectors and the electrical connections which must be made to them. These electrical interconnections are typically thin film metalized conductors that electrically connect the ink ejectors on the printhead to contact pads, thence to printhead interface circuitry in the printer. A technique commonly known as "integrated drive head" or IDH multiplexing is conventionally used to reduce electrical interconnections between a printer and its associated print cartridges. Examples of IDH multiplexing may be found in U.S. Pat. No. 5,541,629 "Printhead with Reduced Interconnections to a Printer". In an IDH design, the ink ejectors (heater resistors) are arranged in groups known as primitives. Each primitive has its own power supply interconnection ("primitive select") and return interconnection ("primitive return" or "primitive common"). In addition, a number of control lines ("address lines") are used to enable particular ink ejectors. These address lines are shared among all primitives. This approach can be thought of as a matrix where the rows are the number of primitives and the columns are the number of resistors per primitive. The energizing of each ink ejector is controlled by a primitive select and by a transistor such as a MOSFET that acts as a switch connected in series with each resistor. By applying a voltage across one or more primitive selects (PS1, PS2, etc.) and the primitive return, and activating the associated gate of a selected transistor, multiple independently addressed ink ejectors may be fired simultaneously.

Figure 5:
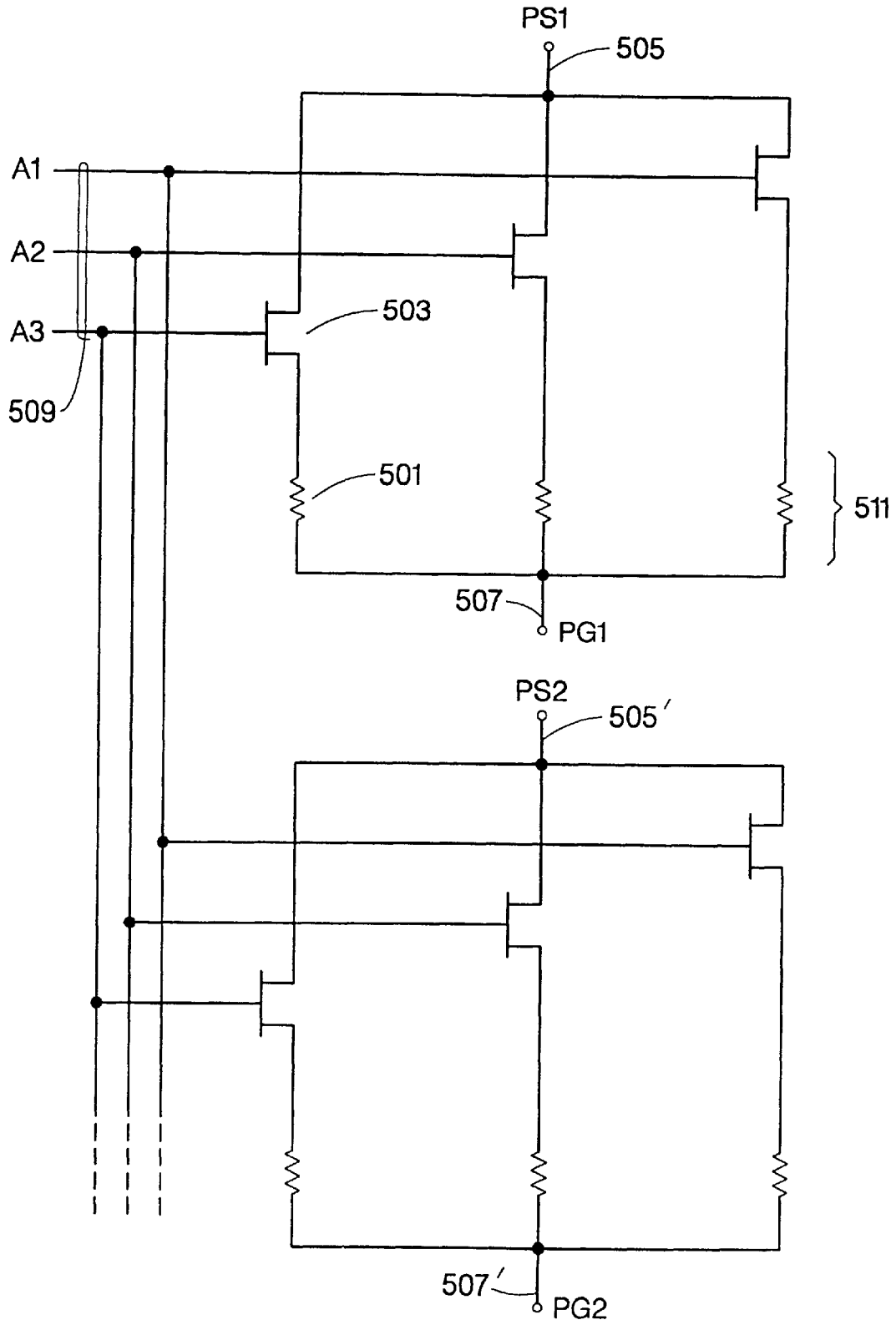
FIG. 5 is a schematic diagram of drop generator matrix circuitry.

FIG. 5 is an electrical schematic that illustrates a typical ink ejector IDH matrix circuitry on the printhead. This configuration enables the selection of which ink ejectors to fire in response to print commands from the electronic controller of the printer. While the matrix is described here in terms of rows and columns, it should be understood that these terms are not to be construed as physical limitations on the arrangement of ink ejectors within the matrix or on the printhead. The ink ejectors are arranged in correspondence with the nozzle orifices and are identified in the electrical matrix by enable signals within a print command directed to the printhead by the printer. Each ink ejector (for example, resistor 501), is energized by a switching device (for example, transistor 503) that is controlled by address interconnections 509. Electrical power is provided via a primitive select (PS(n)) lead 505, and returned through a primitive common (PG(n)) lead 507. Each switching device (e.g. 503) is connected in series with each heater resistor (e.g. 501) between the primitive select 505 and primitive common 507 leads. The address interconnections 509 (e.g. address A3) are connected to the control port of the switching device (e.g. 503) for switching the device between a conductive state and a nonconductive state as commanded by the electronic controller within the printer 101. In the conductive state, the switch device 503 completes a circuit from the primitive select lead 505 through the heater resistor 501 to the primitive common lead 509 to energize the heater resistor when primitive select PS1 is coupled to a source of electrical power.

Each row of ink ejectors in the matrix is deemed a primitive and may be selectively prepared for firing by powering the associated primitive select lead 505, for example PS1, for the row of heater resistors designated 511 in FIG. 5. While only three heater resistors are shown here, it should be understood that any number of heater resistors can be included in a primitive, consistent with the objectives of the designer and the limitations imposed by other printer and printhead constraints. Likewise, the number of primitives is a design choice of the designer. To provide uniform energy for the heater resistors of the primitive, it is preferred that only one series switch device per primitive be energized at a time. However, any number of the primitive selects may be enabled concurrently. Each enabled primitive select, such as PS1 or PS2, thus delivers both power and one of the enable signals to the ink ejector. One other enable signal for the matrix is the address signal provided by each control interconnection 509, such as A1, A2, etc., only one of which is preferably active at a time. Each address interconnection 509 is coupled to all of the switch devices in a matrix column so that all such switch devices in the column are conductive when the interconnection is enabled or "active," i.e. at a voltage level which turns on the switch devices. Where a primitive select and an address interconnection for a heater resistor are both active concurrently, that resistor is electrically energized, rapidly heats, and vaporizes ink in the associated ink-firing chamber.

Figure 6A:
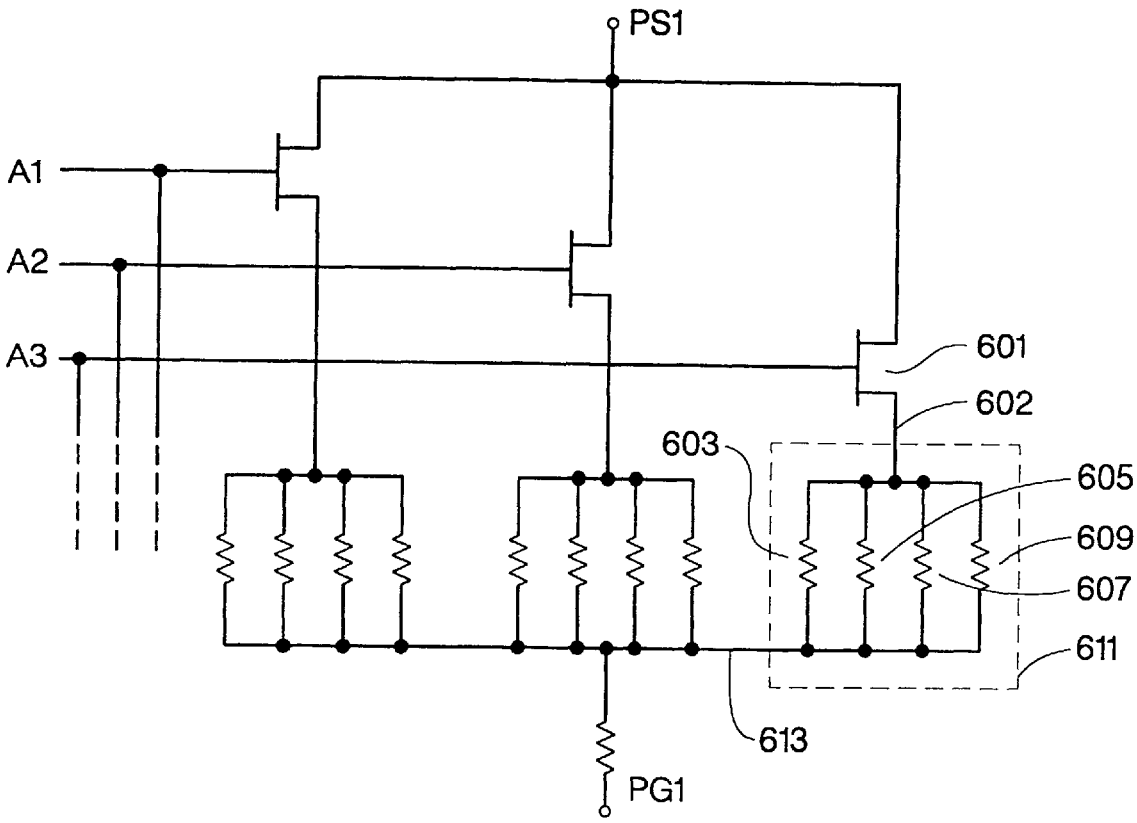
FIG. 6A is a schematic diagram of a first embodiment of a drop generator matrix circuitry for a multiple nozzle drop generator.

For ease of review, only one primitive similar to those of the schematic of FIG. 5 is shown in FIG. 6A. In the FIG. 6A implementation, the energization of a plurality of heater resistors are controlled by a switching device. A multiple nozzle drop generator implementation employs the heater resistor configuration which simultaneously energizes the heater resistors associated with the multiple nozzles of the drop generator. Thus, when the PS1 primitive has been made active, switch device 601 is switched on by address line A3 and passes electric current via conductor 602 to heater resistors 603, 605, 607, 609, which are connected in a parallel arrangement (outlined in broken line as resistor cell 611). The primitive return conductor 613 is common to the heater resistors in the cell 611 as well as heater resistor cells in the primitive.

Figure 6B:
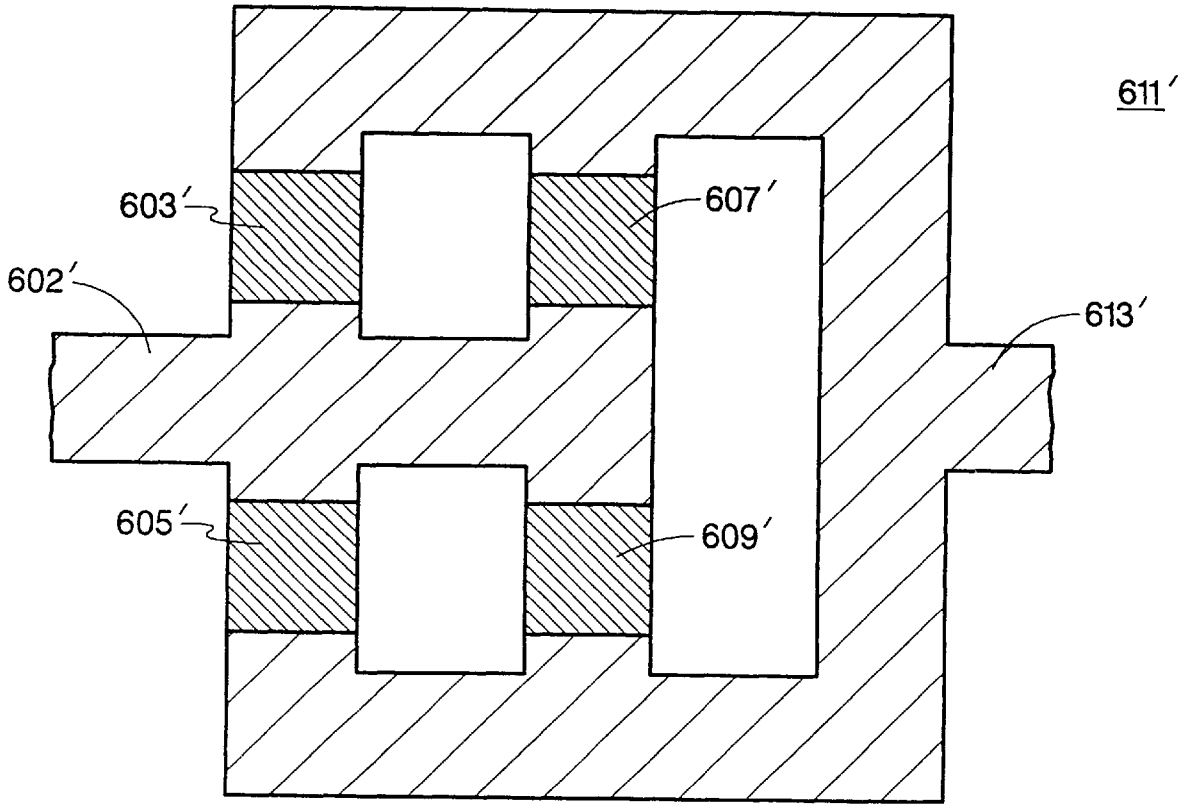
FIG. 6B is an illustration of a physical realization of the ink ejector pattern matrix circuitry of FIG. 6A.

One physical implementation of the arrangement of heater resistors of FIG. 6A is shown in the diagram of the parallel arrangement of the heater resistor cell 611 of FIG. 6B. It is expected that series connected and parallel-series connected resistors will be used when the drop ejector design parameters so require. In the preferred embodiment, thin film heater resistors are created using conventional deposition processes on the insulating support layer of a substrate (as shown in FIG. 3). TaAl thin film resistors 603', 605', 607', and 609' are arranged in an essentially two-dimensional geometric arrangement (a parallelepiped in the shown embodiment) corresponding to an identical arrangement of corresponding nozzles on a one for one basis. The conductor 602 is realized as a thin film metal conductor 602' (such as aluminum) conventionally deposited on the substrate insulating layer and making electrical connection to each of the thin film resistors. The primitive return conductor 613 is also realized as a thin film metal conductor 613' deposited on the insulating support layer of the substrate and making electrical connection to each of the thin film heater resistors opposite the connection of metal layer 602'. In this way a parallel electrical connection is accomplished with the four heater resistors of the ink ejector corresponding to heater resistor cell 611. When electrical voltage is applied across the parallel heater resistors, the electric current flows through each resistor simultaneously, rapidly heating the resistor and vaporizing ink which is held in the firing chambers associated with each of the resistors.

Figure 7A:
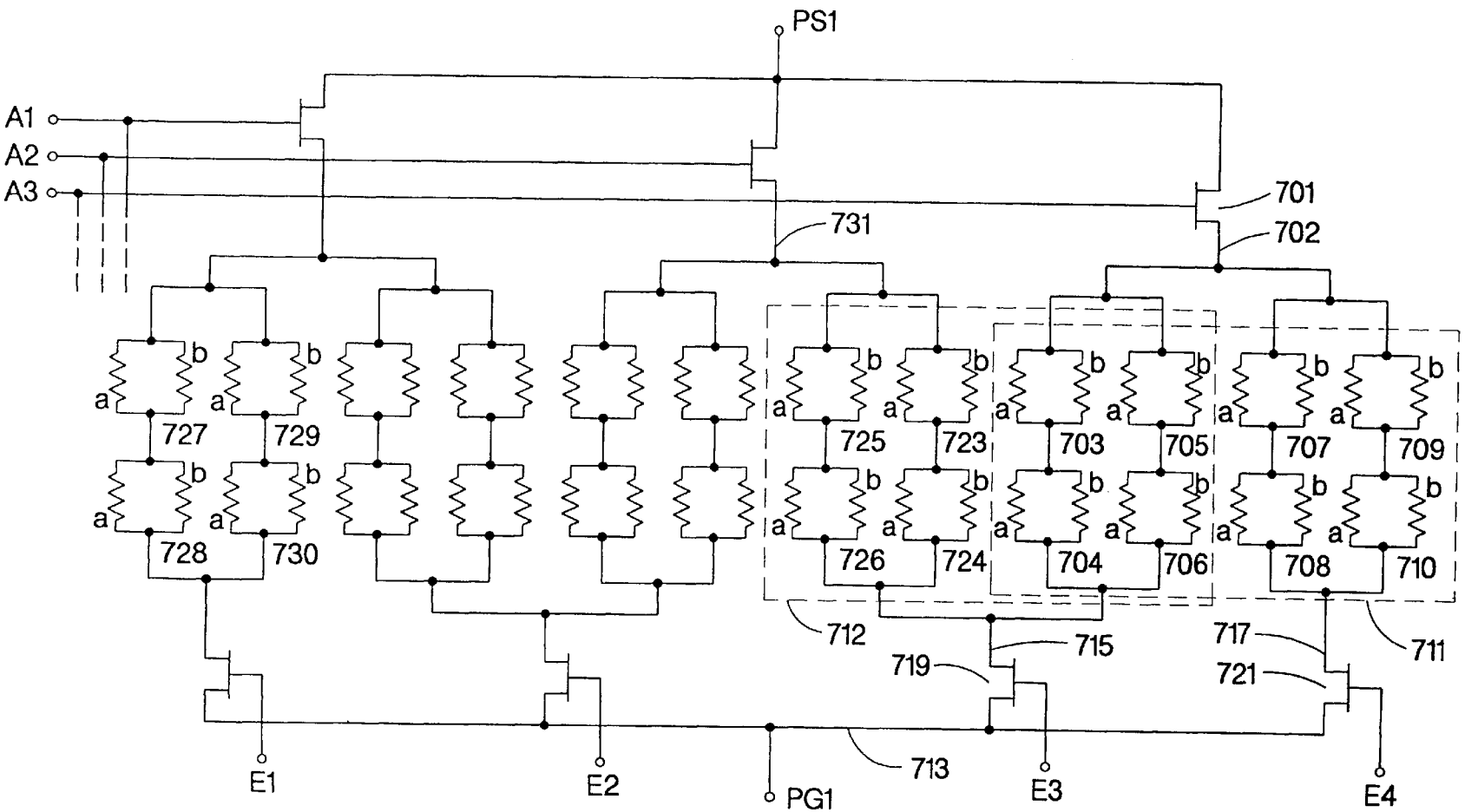
FIG. 7A is a schematic diagram of a second embodiment of a drop generator matrix circuitry for a multiple nozzle drop generator.

A second preferred embodiment is shown in FIG. 7A. Each switch device, in the shown embodiment, energizes eight basic heater resistors in a resistor cell 711 and corresponding to two drop generators each having four nozzles. Each of the basic resistors is comprised of a parallel combination of two resistors that form the ink ejector for one firing chamber and nozzle. Two of the basic resistors are connected in series and four of the series-connected resistors are connected in parallel. Specifically, resistor cell 711 consists of parallel resistors 707*a* and 707*b* series connected with parallel resistors 708*a* and 708*b*. A similar parallel-series connection includes resistors 709*a* and 709*b* in series with resistors 710*a* and 710*b*. Resistors 707*a* through 710*b* comprise the ink ejector of one drop generator in a preferred embodiment. The remainder of cell 711 includes a second drop generator employing a similar parallel-series-parallel connection of resistors 703*a*, 703*b*, 704*a*, 704*b*, 705*a*, 705*b*, 706*a*, and 706*b* as shown in FIG. 7A. When the primitive PS1 is activated (electrical power applied) and the switch device 701 is turned on by address line A3, voltage is applied across the conductor input 702 to the resistor cell 711 and the primitive return 713. The embodiment of FIG. 7A, however, separates this primitive return into two switched primitive returns, for example return 715 and return 717. Connection to the primitive return 713 is controlled by switch devices 719 and 721 (preferably implemented as MOSFET devices).

Heater resistors 707*a*–710*b*, then, are only energized with the aforementioned conditions and when primitive return switch device 721 is turned on by primitive return activation signal E4. In the preferred embodiment, the primitive return activation signals E1–E4 are controlled by the same electronic controller within the printer 101 which creates the address signals A1–A3 from the conventional print instructions received by the printer. Likewise, the parallel heater resistors 703*a* through 706*b*, the ink ejectors of the other drop generator sharing cell 711 are energized when the primitive PS1 is activated, switch device 701 is turned on by an activation signal applied by address line A3, and switch device 719 is turned on by a primitive return activation signal E3. But note, 723*a*, 723*b*, 724*a*, 724*b*, 725*a*, 725*b*, 726*a*, and 726*b*, the parallel-series-parallel ink ejectors of a third drop generator, are also connected to return 715 and share the switching function of primitive return switch 719. Because heater resistors 723*a* through 726*b* are activated by address line A2, however, they are not required to be energized. This alternate sharing of address switch devices and primitive return switch devices is expected to be carried across many drop generators (more than the six illustrated) and to many primitives (more than the one shown in FIG. 7A). Also, the number of resistors per firing chamber, the number of nozzles (and firing chambers) per drop generator, and the series/parallel connection may be varied, as the designer requires. Moreover, a designer may decide to share the primitive return switch device between the heater resistors of the cell activated by address A1 and the heater resistors of the cell activated by address A(n). That is, heater resistors 707*a* through and 710*b* and heater resistors 727*a* through and 730*b* may be arranged to share the same primitive return switch device (e.g. switch device 721).

Figure 7B:
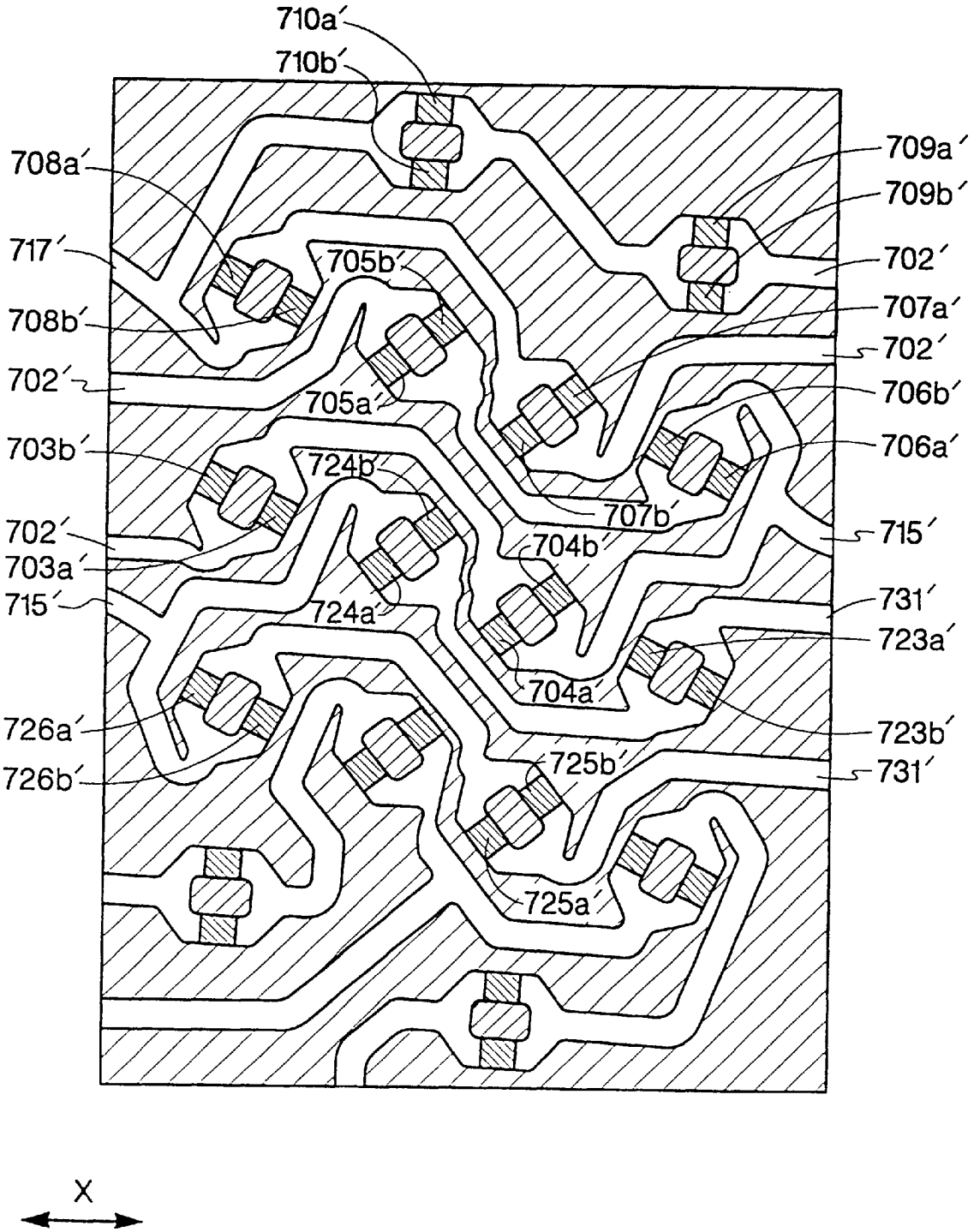
FIG. 7B is an illustration of a physical realization of an ink ejector pattern compatible with the schematic of FIG. 7A.

A layout of heater resistors on an insulating support layer of a substrate corresponding to the schematic of FIG. 7A is shown in FIG. 7B. In the second embodiment of the present to invention, the thin film heater resistors are created of tantalum-aluminum using conventional depositional processes on the insulating support layer of the substrate. A plurality of heater resistors are shown and are equated to the schematic representation thereof. The thin film resistors 703*a*', and 703*b*', 704*a*' and 704*b*', 705*a*' and 705*b*' and 706*a*' and 706*b*', as well as 707*a*' through 710*b*', 723*a*' through 726*b*', and 727*a*' through 730*b*' (each grouping corresponding to the ink ejectors of a single drop generator) are each arranged in an essentially two-dimensional geometric arrangement (a parallelogram in the shown embodiment) corresponding to an identical arrangement of corresponding nozzles such as that shown in FIG. 4B. Electrical conductors 702 and 731 are realized in the preferred embodiment as thin film aluminum conductors 702' and 731' conventionally deposited on the substrate insulating support layer. Conductor 702' electrically connects to each of the thin film heater resistors in the resistor cell 711 of one ink ejector. Conductor 731' electrically connects to the thin film heater resistors, of another cell of another resistor cell of another drop generator. The split primitive returns 717 and 715 are also realized as thin film metal conductors 717' and 715' deposited on the insulating support layer of the substrate. Split primitive return conductor 717' makes electrical connection to the parallel-series-parallel connection of the thin film heater resistors 707*a*' through 710*b*' at a point electrically opposite the connection of metal layer 702'. The split primitive return conductor 715' makes electrical connection to the parallel-series-parallel connection of thin film heater resistors 703*a*' through 706*b*' of the resistor cell 711, as well as parallel-series-parallel heater resistors 723*a*' through 726*b*' of the neighboring resistor cell. Although only the three addressed resistor cells have been illustrated, additional address lines, switches and resistor cells may be added as deemed necessary for the printhead implementation. FIG. 4B, for example, illustrates one additional ink ejector nozzle configuration which matches and expands upon the heater resistor and conductor arrangement of FIG. 7B.

Figure 7C:
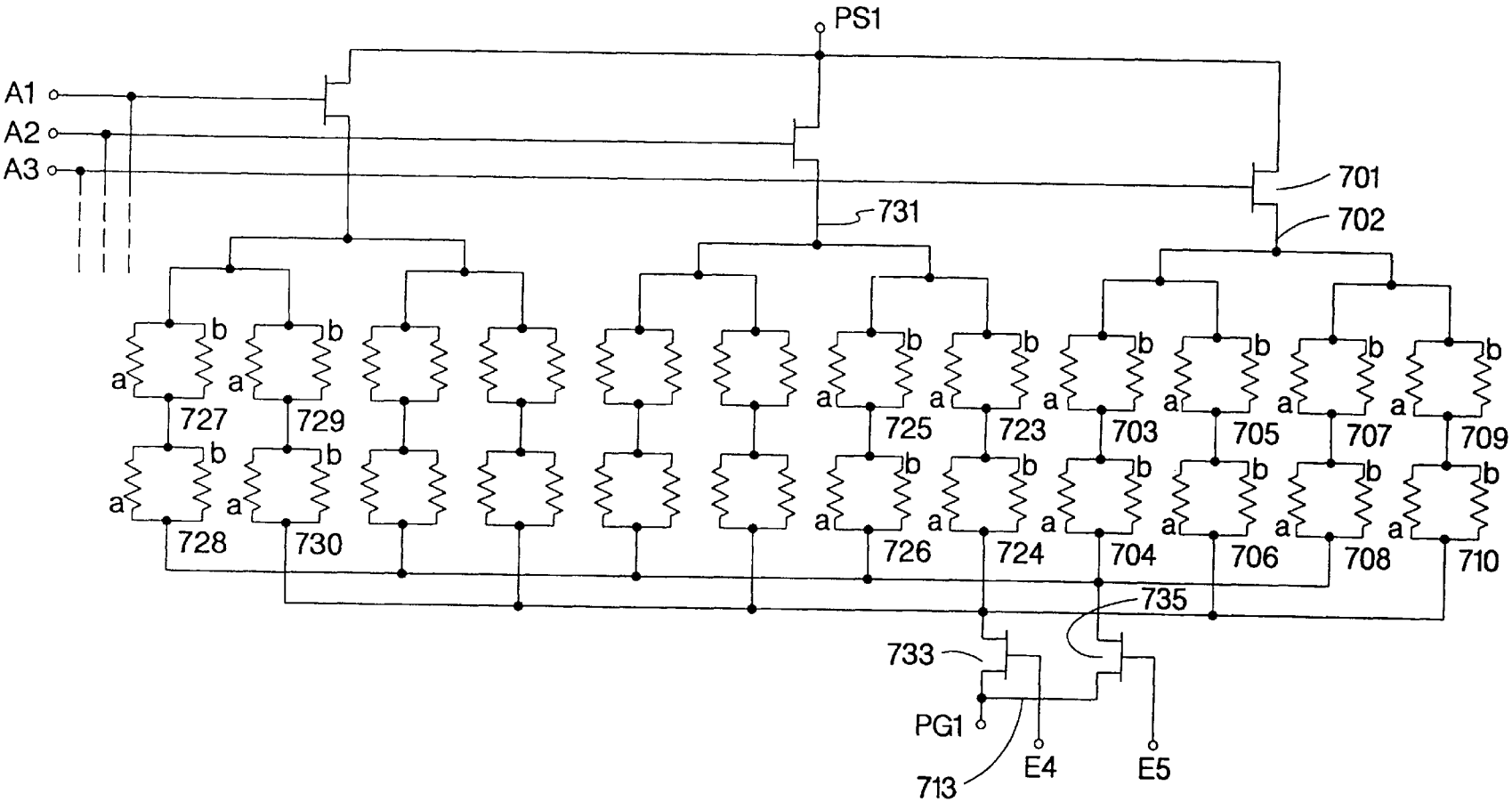
FIG. 7C is a schematic diagram of an alternative embodiment of the drop generator circuitry of FIG. 7A.

An alternative electrical connection is illustrated in the schematic diagram of FIG. 7C. In this arrangement, one of the parallel-series connection of heater resistors of each drop generator is connected to primitive return 713 by way of a switch device 733 while the other parallel-series connection of heater resistors of each drop generator is connected to primitive return 713 by way of switch device 735. Separate primitive return activation signals E4 and E5 are coupled to the control ports of switch devices 733 and 735 so that one-half of the nozzles of each drop generator are allowed to be energized when one of the return activation signals is enabled. The advantages offered by this arrangement can be appreciated by returning to FIG. 7B.

The direction of print cartridge scan in the printer, X, is indicated in FIG. 7B. When one of the drop generators is activated (for example, the drop generator employing heater resistors 703*a*', 703*b*', 704*a*', 704*b*', 705*a*', 705*b*', 706*a*', and 706*b*') four. droplets of ink are expelled from the four nozzles associated with these heater resistors. Four ink dots are placed on the medium in an area larger than a standard pixel, an extended pixel. Likewise, a second drop generator (for example, the drop generator employing heater resistors 723*a*', 723*b*', 724*a*', 724*b*', 725*a*', 725*b*', 726*a*', and 726*b*') expels four ink droplets from its four nozzles and four more ink dots are placed on the medium. It is a feature of the present invention that some of these four additional ink dots are placed between some of the ink dots deposited by the 703*a*'–706*b*' heater resistor drop generator. The print cartridge is then advanced in the X direction for additional droplet expulsion. It can be seen, then, that the printed (discontinuous) pixels from some of the drop generators are interdigitated with the printed (discontinuous) pixels of other drop generators. In this example, each discontinuous pixel of a given drop generator has four ink dots.

In some instances, it is desirable to have fewer than four ink dots deposited in the discontinuous pixel. Such instance can arise, for example, in color printing when certain hues or saturation levels are needed and fewer ink dots per pixel will provide the answer. (It is an advantage that a variable number of ink dots can be selected and placed while the print cartridge is scanning in one direction—multiple passes to place a varying number of dots in a pixel slows the rate of printing considerably).

When the present invention is employed in the embodiment having a split primitive return providing independent control of some of the ink ejectors of a drop generator (such as that shown in FIG. 7C) a quantity of ink dots fewer than all that could be deposited by a drop generator may be deposited. Thus, when switch device 733 is conducting while switch device 735 is not, heater resistors 705*a*', 705*b*', 706*a*', and 706*b*' (as well as 709*a*', 709*b*', 710*a*', and 710*b*') are energized when primitive PS1 is energized and when switch device 701 is made conducting. Heater resistors 703*a*' 703*b*', 704*a*', and 704*b*' (as well as 707*a*', 707*b*', 708*a*', and 708*b*') are not energized. The result is that one-half of the number of ink ejectors per drop generator are enabled to eject an ink droplet. A more precise control of each drop generator may be realized by having more primitive return switch devices, such as those of FIG. 7A, connected to the drop generators.

Thus, a printer employing an arrangement of coordinated ink-expelling nozzles in which the nozzle pattern of one drop generator overlaps the nozzle pattern of another drop generator and in which the number of simultaneously expelling nozzles can be variably selected will realize an improved visual dynamic range concurrent with reduced quantization and granularity.

We claim:

1. An inkjet printing device comprising:

a first drop generator activated by a first signal, said first drop generator including at least two associated nozzles and respective ink ejectors, each nozzle of said at least two associated nozzles of said first drop generator arranged in a first geometric pattern with each other nozzle of said first drop generator;

a second drop generator activated by a second signal, said second drop generator including at least two associated nozzles and respective ink ejectors, each nozzle of said at least two nozzles of said second drop generator arranged in a second geometric pattern with each other nozzle of said second drop generator; and wherein at least one nozzle associated with said second drop generator is disposed on or within a perimeter of said first geometric pattern of nozzles of said first drop generator.

2. An inkjet printing device in accordance with claim 1 wherein said first drop generator includes four associated nozzles and associated ink ejectors and said first geometric pattern is a parallelogram.

3. An inkjet printing device in accordance with claim 1 wherein said first drop generator simultaneously ejects ink droplets from each of said at least two associated nozzles to deposit ink dots in an extended pixel on a medium.

4. A method of depositing ink dots on a medium by employing drop generators each having a plurality of cooperating ink ejectors, comprising the steps of:

simultaneously activating all of the ink ejectors arranged in a first geometric pattern to form a first drop generator to deposit a first plurality of ink dots on the medium in a geometric pattern corresponding to said first geometric pattern; and simultaneously activing all of the ink ejectors arranged in a second geometric pattern to form a second drop generator to deposit a second plurality of ink dots on the medium in a geometric pattern corresponding to said second geometric pattern, at least one dot of said second plurality of dots being deposited on or within a perimeter of said geometric pattern corresponding to said first geometric pattern.

5. A method in accordance with the method of claim 4 further comprising the steps of:

repositioning said first and second drop generators with respect to the medium; and activating at least one but fewer than all of the ink ejectors of said first drop generator to deposit at least one ink dot on the medium.

6. A method of depositing ink dots on a medium by employing drop generators each having a plurality of cooperating ink ejectors, comprising the steps of:

simultaneously activating all of the ink ejectors arranged in a first geometric pattern to form a first drop generator to deposit a first plurality of ink dots on the medium;

simultaneously activating all of the ink ejectors arranged in a second geometric pattern to form a second drop generator to deposit a second plurality of ink dots on the medium;

repositioning said first and second drop generators with respect to the medium; and activating at least one but fewer than all of the ink ejectors of said first drop generator to deposit at least one ink dot on the medium.

7. A method of depositing ink dots on a medium by employing drop generators each having a plurality of cooperating ink ejectors that are energized by a first primitive signal applied between an input and a return, comprising the steps of:

switchably coupling all of the ink ejectors of a first drop generator to an input of the first primitive signal and switchably coupling, independently from said switchable coupling to said first primitive signal, all of the ink ejectors of the first drop generator to the return to expel a first plurality of ink droplets;

switchably coupling all of the ink ejectors of a second drop generator to the input of the first primitive signal and switchably coupling, independently from said switchable coupling to said first primitive signal, all of the ink ejectors of the second drop generator to the return to expel a second plurality of ink droplets;

repositioning said first and second drop generators with respect to the medium; and switchably coupling all of the ink ejectors of the first drop generator to an input of the first primitive signal and switchably coupling at least one but fewer than all of the ink ejectors of the first drop generator to the return to expel at least one ink droplet from the first drop generator.

8. A method in accordance with the method of claim 7 further comprising the step of switchably coupling all of the ink ejectors of the second drop generator to an input of the first primitive signal and switchably coupling at least one but fewer than all of the ink ejectors of the second drop generator to the return to expel at least one ink droplet from the second drop generator.

9. A method in accordance with the method of claim 7 wherein said step of switchably coupling all of the ink ejectors of a first drop generator further comprises the step of depositing said first plurality of ink droplets as dots in a first geometric pattern on the medium, and said step of switchably coupling all of the ink ejectors of a second drop generator further comprises the step of depositing said second plurality of ink droplets as dots in a second geometric pattern on the medium such that at least one dot of said second plurality of dots is deposited on or within the perimeter of said first geometric pattern.

10. A method of manufacture of an inkjet printing device comprising the steps of:

arranging simultaneously energized nozzles and ink ejectors of a first drop generator in a first geometric pattern with each other nozzle of said first drop generator; and arranging simultaneously energized nozzles and ink ejectors of a second drop generator in a second geometric pattern with each other nozzle of said second drop generator in which at least one nozzle of said second drop generator is disposed on or within the perimeter of said first geometric pattern.

11. A method of manufacture in accordance with the method of claim 10 further comprising the steps of:

forming said first drop generator with four associated nozzles and associated ink ejectors; and arranging said four associated nozzles into said first geometric pattern as a parallelogram.

* * * * *